United States Patent [19]

Bruno

[11] 4,130,953

[45] Dec. 26, 1978

[54] SNOW JACK

[76] Inventor: Anthony T. Bruno, 103 19th Ave., Belmar, N.J. 07719

[21] Appl. No.: 861,719

[22] Filed: Dec. 19, 1977

[51] Int. Cl.[2] ..... E01H 5/02

[52] U.S. Cl. ..... 37/130; 294/53.5; 294/54; 294/55; 280/47.26

[58] Field of Search ..... 37/53, 130, 131, 134; 294/53.5, 54, 55; 280/47.26

[56] References Cited

U.S. PATENT DOCUMENTS

| | | | |
|---|---|---|---|
| 866,638 | 9/1907 | Ewers | 37/53 X |
| 887,874 | 5/1908 | Toy | 37/130 |
| 1,162,845 | 12/1915 | Armstrong | 294/53.5 |
| 1,264,640 | 4/1918 | Hall | 294/53.5 |
| 2,470,217 | 5/1949 | McLoughlin | 37/130 |
| 2,846,785 | 8/1958 | Underwood | 37/53 |
| 2,908,090 | 10/1959 | Eifel | 37/53 |
| 3,748,761 | 7/1973 | Chetwynde | 37/53 X |

FOREIGN PATENT DOCUMENTS

| | | | |
|---|---|---|---|
| 185302 | 4/1956 | Austria | 37/130 |
| 173296 | 12/1903 | Fed. Rep. of Germany | 37/130 |
| 1418935 | 10/1965 | France | 37/53 |
| 617697 | 2/1949 | United Kingdom | 37/53 |

*Primary Examiner*—E. H. Eickholt
*Attorney, Agent, or Firm*—Charles F. Gunderson

[57] ABSTRACT

A snow removing device has a scoop or shovel pivotably mounted at one end of a lever arm whose other end has a handle. The lever arm is mounted on a pedestal in such a manner that it can be pivoted in a horizontal plane to raise and lower the scoop by means of the handle, and pivoted in a vertical plane to move the scoop to one side or the other. The pedestal is mounted on a sled, with optional wheels, so that, with the scoop positioned in front of the sled, the device can be pushed forward until the scoop is full of snow. The operator can then lever up the load of snow, and rotate the scoop to one side or the other whereat a release catch can be actuated to drop the load of snow.

4 Claims, 4 Drawing Figures

FIG. 1
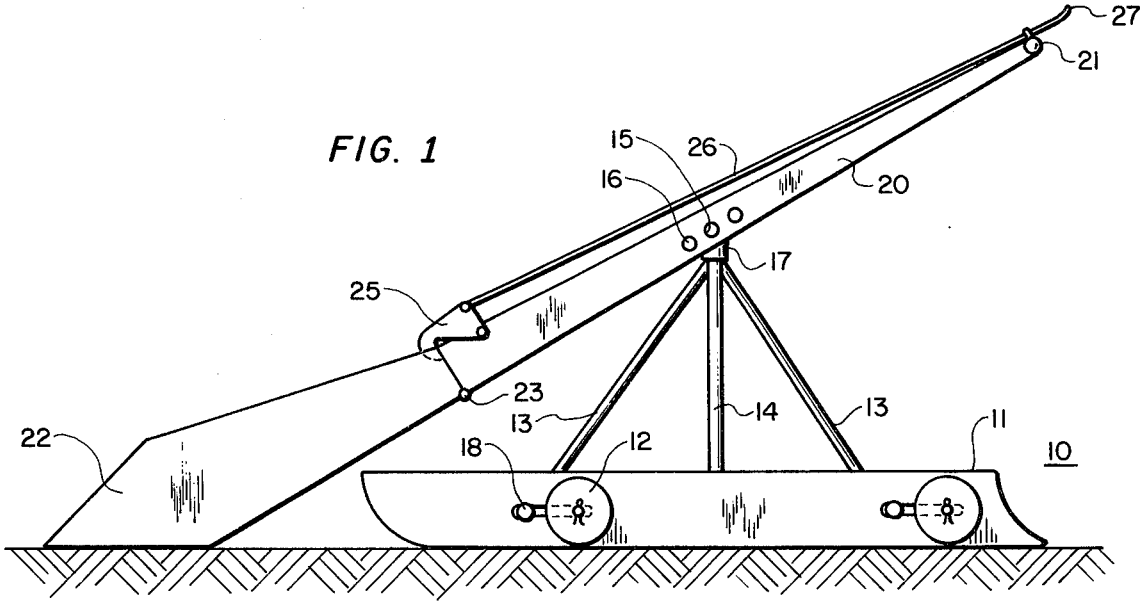
FIG. 2
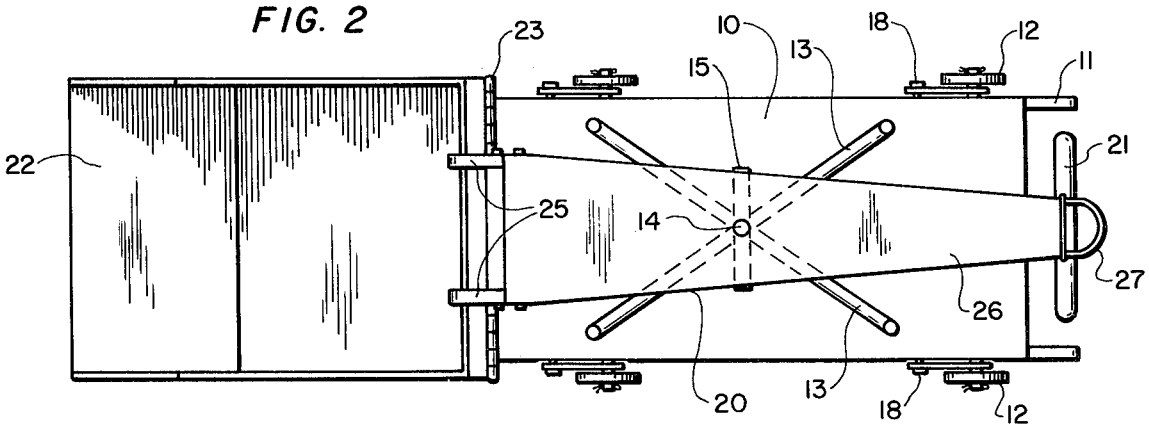
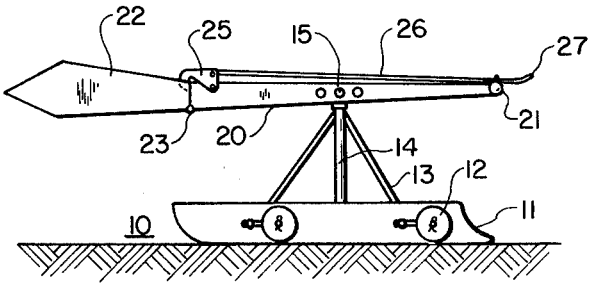
FIG. 3
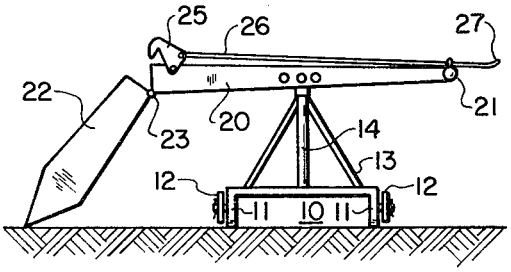
FIG. 4

SNOW JACK

BACKGROUND OF THE INVENTION

There are innumerable devices for shoveling snow, from variations of the standard coal shovel to larger and more intricate designs to more effectively pick up snow, or to merely shove it along the ground. There are also mechanisms mounted on a vehicle to provide mechanical advantage to handle larger amounts of snow. All of these devices can be assumed to operate more or less effectively, but all have limitations.

Some of these devices use wheels as a fulcrum to support a lever with a scoop on one end and a handle on the other end to scoop up the snow and to move in one direction or another to empty the snow. A typical example of this type of device is seen in the two-wheeled side-dumping scoop of Underwood, U.S. Pat. No. 2,846,785, issued Aug. 12, 1958.

A few others such as the Snow Shovelling Apparatus of Malickson, U.S. Pat. No. 3,469,326, issued Sept. 30, 1969, have a four wheeled base support, a scoop to pick up the snow ahead of the vehicle, and a mechanism to lift and throw the snow in the scoop to the side.

Such devices have limited scope in the maneuvering of the snow and certain mechanical problems and complexities to perform this function.

It is therefore an object of this invention to provide a mechanism for removing snow that is simple, versatile, mobile and effective in a variety of conditions.

It is a further object of this invention to provide a snow removing device that has leverage to accommodate large loads of snow by an average operator.

It is a further object of this invention to provide a health-saving snow removing device that can be more safely used by older people; people who have back problems or heart conditions; or people who must avoid muscular strain.

SUMMARY OF THE INVENTION

A device for removing snow is based on a sled-like structure, that may have auxilliary wheels, that supports a pedestal that in turn supports a lever arm at its fulcrum. The lever arm has a handle at one end and a scoop at the other end. The lever arm is moveable in a vertical plane about a horizontal axis at its fulcrum, and also in a horizontal plane about a vertical axis at its fulcrum where it joins the pedestal. The snow is scooped up ahead of the sled-like structure, jacked up by the lever arm on the horizontal axis, and swung around on the vertical axis to be dumped on one side or the other. The scoop is hinged on the lever arm, for this purpose, and held in an operating position by a releasable catch that is actuated by a release mechanism near the handle to drop the scoop and dump the snow when it has been moved to the desired position on one side or the other.

BRIEF DESCRIPTION OF THE DRAWINGS

FIG. 1 shows a side view of the device;

FIG. 2 shows a top view of the device;

FIGS. 3 and 4 show side views of the lever arm in operation on the sled.

DESCRIPTION OF THE PREFERRED EMBODIMENT

Referring now more particularly to FIG. 1, a side view of the device is seen mounted on a vehicle 10 with runners 11, and auxilliary wheels 12. The auxilliary wheels 12 may be pivoted about pivots 18 to be raised or lowered. Braces 13 support a pedestal 14 which, in turn, supports a lever arm 20 at its fulcrum 15. A collar 17 supports a vertical pivoting rod or mechanism, which in turn supports another horizontal rod or mechanism that provides the fulcrum 15. The fulcrum 15 may have alternate mounting positions 16, in the lever arm 20.

The lever arm 20 has a handle 21 at one end and a scoop 22 at the other end. The scoop is attached to the lever arm by a horizontal hinge 23 and a releasable catch 25, which is connected to a release mechanism 27 by a rod or coupling 26.

In operation, the scoop 22 is positioned ahead of the mounting vehicle 10 so that when the vehicle is pushed forward, the scoop will be filled with snow. When sufficient snow is in the scoop, the handle 21 can be depressed so that the lever arm 20 will raise the scoop-full of snow to any desired height above the level of the snow. The handle can then be rotated to one side or the other to move the scoop-full of snow away from the area being cleared. At this point the release 27 can be actuated to disengage the releasable catch 25 through the release rod 26. This causes the scoop 22 to pivot about the hinge 23 and drop, as seen in FIG. 4, to empty the snow so that the operation can be repeated.

FIG. 2 shows a top view of the same device with similar elements similarly numbered. The mounting vehicle 10 again has its runners 11 and auxilliary wheels 12 pivoted on the runners at 18. The braces 13 again support the pedestal 14 which supports the horizontal pivot 15 that forms the fulcrum for the lever arm 20. The handle 21, the scoop 22, and releasable catch 25 are seen in their mounting on the lever arm, as is the release mechanism 27 and a typical release rod or coupling 26.

FIGS. 3 and 4 show the device of FIGS. 1 and 2 in operation. In these figures, similar elements are similarly numbered. In FIG. 3, the handle 21 is seen depressed to bring the scoop 22 well above the probable level of the snow, not shown for simplicity, since this device would be effective over a wide range of depths of snow. The scoop is seen here above the front of the sled 11.

FIG. 4 shows the lever arm 20 rotated by the handle 21 about the vertical pivot at the fulcrum to the side of the sled 10. The releasable catch 25 is shown here actuated by the release 27 through its coupling 26 and the scoop 22 is seen dropped to empty any snow in the scoop. At this point the scoop can be swung about its vertical axis back to the front of the device, and the handle can be raised again to return the scoop to its original position in line with the lever arm to reengage the releasable catch 25 so that the operation can be repeated. The releasable catch may by spring-charged to reengage the scoop when it is returned to its operating position.

A typical release catch mechanism is shown, but it will be obvious that other releasable mechanical couplings are possible and may be equally effective for controlling the scoop during the operation of this device. The releasable catch and its controlling rod and release element must be strong enough to accommodate the predictable loads of snow in the scoop with the forces involved with respect to the hinge and the other elements of the lever arm. Additional catches may be provided for additional strength.

The lever arm 20 may be of any length that will provide the most effective leverage, and control of the device. A longer lever arm will provide more leverage, but will provide less mobility of the scoop. Conversely, a shorter lever arm will provide faster motion of the scoop, but require greated effort.

The mechanical advantage of the lever arm can be controlled by the position of the horizontal fulcrum pivot 15 which may be anywheres along the lever arm, at any of the alternate locations, such as 16, or at others not shown.

A typical pedestal 14 is shown with typical support such as the braces 13 as shown. In this typical embodiment, the pedestal 14 may be a tubular member which may serve as the vertical axis within which another, smaller, tubular member, or rod may fit in a rotatable manner. Such a tubular member or rod could be supported on a bearing such as 17 that could be adjustable along the inner tubular member or rod to vary the height of the horizontal fulcrum axis 15 while permitting full, 360° rotary motion about the vertical axis.

While a simple pipe-within-a-pipe is shown as a typical embodiment of this invention for the vertical pivot, and a teeshaped cross member is shown for the horizontal fulcrum pivot for the lever arm, it is obvious to anyone skilled in the art that other types of vertical and horizontal pivots may be adapted for use here.

Auxilliary wheels such as 12 may or may not be necessary, but could be desirable for use in very light snow, or for mobility of the device in a storage area or when there is no snow. The wheels 12, in a typical embodiment, may be on axels that are pivoted on arms about pivots 18 to extend below the runners 11 when desired, or to be well above the runners when not in use. Other well known mechanisms for controlling the height of such wheels would also be applicable here.

The size and shape of the scoop may be any that will be manageable and most effective here. The scoop may be wider and longer where lighter snow is anticipated, or may be narrower and shorter where deeper snows are anticipated. Also the angle of the scoop and its height above the lever arm may be adjustable by movement of the hinge 23 or catches 25 to accommodate varying snow conditions.

Similarly, the length of the lever arm, and the position of the fulcrum can be chosen to be accommodated to the weight of the snow and the strength of the user.

It is to be understood that I do not desire to be limited to the exact details of construction shown and described since obvious modifications will occur to a person skilled in the art.

What is claimed is:

1. A manual device for removing snow comprising: a sled; a pedestal extending upwardly from the center portion of said sled; a lever arm; a handle at one end of said lever arm; a snow scoop at the other end of said lever arm; said snow scoop being coupled to the other end of said lever arm by a lower, horizontal hinge and an upper releasable catch; a release mechanism positioned adjacent to said handle; means for coupling said release mechanism to said releasable catch; means for coupling a first, horizontal pivoting mechanism to the center portion of said lever arm at the upper end of said pedestal; means for connecting a second, vertical pivoting means mecanism to said center portion of said lever arm at said upper end of said pedestal; and means for connecting said first horizontal pivoting mechanism and said second vertical pivoting mechanism to said pedestal to be supported thereby, whereby said snow scoop can be positioned in front of said sled, which can be moved forward until the scoop is full of snow, whereat the handle can be moved downwardly, to raise said scoop, and sidewardly to rotate said scoop to the side before actuating said release mechanism to drop said scoop load of snow.

2. A manual device for removing snow, as in claim 1 having wheels pivotably attached to each of the runners of said sled, and means for raising and lowering said wheels, to be above or below the bottoms of said runners, and to be disengaged or to support the weight of said device.

3. A manual device for removing snow as in claim 1 having means for adjusting the height of said means for connecting said first horizontal pivoting mechanism and said second vertical pivoting mechanism to said pedestal with respect to said pedestal, to vary the height of said lever arm.

4. A manual device for removing snow as in claim 1 having means for varying the means for coupling the said first horizontal pivoting mechanism with respect to said lever arm, to vary the position of the fulcrum at said center portion of said lever arm and the mechanical advantage of said lever arm.

* * * * *